US007614380B2

(12) United States Patent
Tsutsui et al.

(10) Patent No.: US 7,614,380 B2
(45) Date of Patent: Nov. 10, 2009

(54) INTAKE DEVICE FOR A MOTORCYCLE

(75) Inventors: Noriyoshi Tsutsui, Saitama (JP); Hideki Kido, Saitama (JP); Naoshi Iizuka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 17 days.

(21) Appl. No.: 11/896,248

(22) Filed: Aug. 30, 2007

(65) Prior Publication Data

US 2008/0053394 A1 Mar. 6, 2008

(30) Foreign Application Priority Data

Sep. 4, 2006 (JP) ..... 2006-238577

(51) Int. Cl.
*F02M 35/10* (2006.01)
*F02B 77/04* (2006.01)

(52) U.S. Cl. ..... 123/184.57; 123/198 E; 181/229

(58) Field of Classification Search ..... 123/184.57, 123/198 E; 181/204, 229
See application file for complete search history.

(56) References Cited

FOREIGN PATENT DOCUMENTS

| | | | | |
|---|---|---|---|---|
| EP | 1582734 | A1 | | 10/2005 |
| GB | 2399599 | A | | 9/2004 |
| JP | 59-5868 | A | | 1/1984 |
| JP | 4-306185 | A | | 10/1992 |
| JP | 11-351085 | A | | 12/1999 |
| JP | 2001020812 | A | * | 1/2001 |
| JP | 2002285924 | A | * | 10/2002 |

* cited by examiner

*Primary Examiner*—Noah Kamen
(74) *Attorney, Agent, or Firm*—Birch, Stewart, Kolasch & Birch, LLP

(57) ABSTRACT

To provide an intake system of a motorcycle, which is capable of attenuating intake noise efficiently, and facilitating arrangement of resonators. An air cleaner includes an air cleaner case having an element and an expansion chamber with an intake passage connected thereto. Intake ducts introduce outside air into the air cleaner case. Resonators are provided on the expansion chamber and intake ducts, respectively.

16 Claims, 10 Drawing Sheets

INTAKE DEVICE FOR A MOTORCYCLE

CROSS-REFERENCE TO RELATED APPLICATIONS

This nonprovisional application claims priority under 35 U.S.C. §119(a) on Patent Application No. 2006-238577, filed in Japan on Sep. 4, 2006, the entirety of which is incorporated herein by reference.

BACKGROUND OF THE INVENTION

1. Field of the Invention

The present invention relates to an intake system of a motorcycle in which an air cleaner is connected to an upstream side of intake passages connected to intake ports of respective cylinders of an engine, and resonators are provided on the air cleaner.

2. Background of the Invention

There is a motorcycle in which an air cleaner is connected to an upstream side of intake passages connected to intake ports of respective cylinders of an engine, and resonators are provided on the air cleaner. In this type of motorcycle, proposed is one in which the resonators are provided on both side portions of an air cleaner case, whereby intake noise of the engine, which is emitted from the air cleaner to the outside, is attenuated by the resonators (for example, refer to Japanese Unexamined Patent Application Publication No. Sho 59-5868).

However, in the conventional construction, since the resonators are located apart from the engine as a main source (sound source) of the intake noise, there is concern that the intake noise cannot be attenuated sufficiently. Moreover, since the resonators are provided on both side portions of the air cleaner, capacities of the resonators are limited due to limitations on a width dimension of the air cleaner. Meanwhile, since various parts such as a vehicle body frame are disposed in the periphery of the air cleaner, which is regions other than both side portions, there is a problem that it is difficult to arrange the resonators with sufficient capacities.

SUMMARY OF THE INVENTION

The present invention has been made in consideration for the above-described circumstances. It is an object of the present invention to provide an intake system of a motorcycle, which is capable of efficiently attenuating the intake noise and facilitating the arrangement of the resonators.

In order to achieve the above-described object, the present invention provides an intake system of a motorcycle, in which system an air cleaner is connected to an upstream side of an intake passage connected to an intake port of a cylinder of an engine, and in which system resonators are provided on the air cleaner. The air cleaner in the system includes: an air cleaner case having an expansion chamber to which the intake passage is connected and an element; and an intake duct introducing outside air into the air cleaner case. The resonators in the system are individually provided on the expansion chamber and the intake duct. According to this invention, the resonators are individually provided on the expansion chamber and the intake duct. As a result, intake noise can be attenuated at positions close to the engine as a main source of the intake noise, and in addition, the intake noise in the intake duct as an outlet of the intake noise, can be attenuated. In such a way, the intake noise can be attenuated efficiently. Moreover, since the resonators are arranged in a dispersed manner, the resonators can be arranged easily.

In this case, preferably, a pair of the intake ducts are provided on left and right sides of the air cleaner case, the intake duct on a first side is made longer than the intake duct on a second side, and the capacity of the resonator provided on the intake duct on the first side is made larger than a capacity of the resonator provided on the intake duct on the second side. With this construction, a larger duct area and a larger duct capacity can be obtained, and in addition, the intake noise in the respective intake ducts can be attenuated appropriately. In this case, preferably, the intake duct on the first side includes an opening/closing valve opening and closing an opening of the intake duct. With this construction, the opening/closing valve can be arranged easily in the intake duct, so that the duct area can be varied.

Moreover, preferably, the air cleaner is disposed adjacent to a lower portion of a main tube extended in a fore and aft direction of a vehicle body, the resonator provided on the expansion chamber is disposed on a side of the main tube on an upper surface of the air cleaner case, a pair of the intake ducts are provided on left and right sides of the air cleaner case, and the resonators are individually provided on the pair of intake ducts. With this construction, the resonators can be arranged at positions where interference thereof with the main tube is avoided.

In the present invention, the air cleaner includes: the air cleaner case having the expansion chamber to which the intake passage is connected, and the element; and the intake duct introducing the outside air into the air cleaner case. The resonators are individually provided on the expansion chamber and the intake duct. Accordingly, the intake noise can be attenuated at the positions close to the engine as the main source of the intake system, and in addition, the intake noise in the intake duct as the outlet of the intake noise can be attenuated. In such a way, the intake noise can be attenuated efficiently, and in addition, the resonators can be arranged easily.

Moreover, the pair of intake ducts are provided on the left and right sides of the air cleaner case, the intake duct on the first side is made longer than the intake duct on the second side, and the capacity of the resonator provided on the intake duct on the first side is made larger than the capacity of the resonator provided on the intake duct on the second side. Accordingly, the duct area and the duct capacity can be made larger, and in addition, the intake noise in the respective intake ducts can be attenuated appropriately.

Furthermore, since the intake duct on the first side includes the opening/closing valve opening and closing the opening of the intake duct, the opening/closing valve can be arranged easily in the intake duct, so that the duct area can be varied.

Moreover, the air cleaner is disposed adjacent to the lower portion of the main tube extended in the fore and aft direction of the vehicle body, the resonator provided on the expansion chamber is disposed on the side of the main tube on the upper surface of the air cleaner case, the pair of intake ducts are provided on the left and right sides of the air cleaner case, and the resonators are individually provided on the pair of intake ducts. Accordingly, the resonators can be arranged at the positions where the interference thereof with the main tube is avoided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
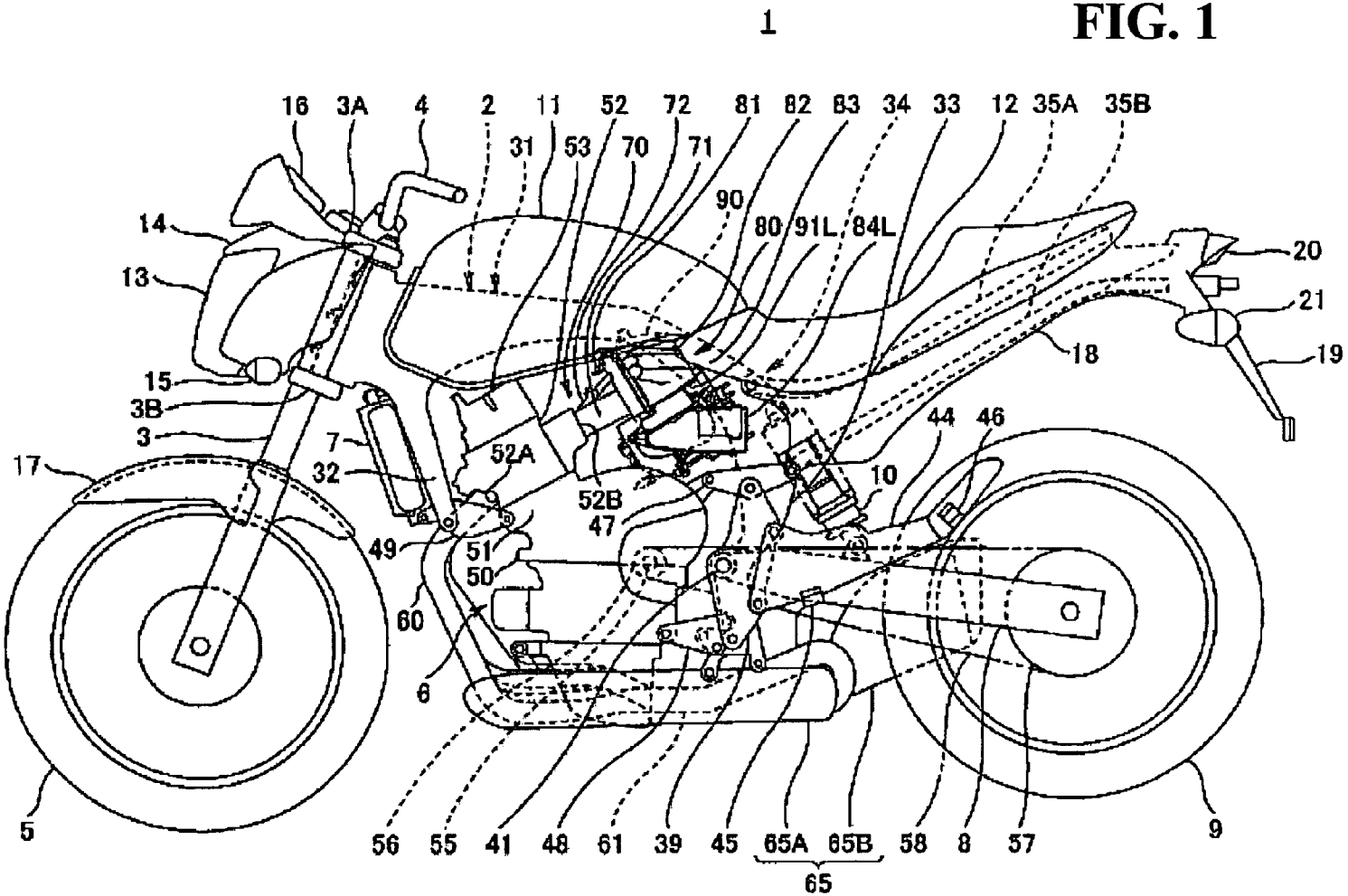
FIG. 1 is a side view of a motorcycle according to this embodiment.

The present invention will now be described in detail with reference to the accompanying drawings, wherein the same reference numerals will be used to identify the same or similar elements throughout the several views. Note that, in the explanation, descriptions of directions such as front and rear, left and right, and upper and lower are defined with respect to a vehicle body.

FIG. 1 is a side view of a motorcycle according to this embodiment. This motorcycle 1 includes: a vehicle body frame 2; a left and right pair of front forks 3 and 3 freely steerably supported on a front portion of the vehicle body frame 2; a steering handle 4 attached to a top bridge 3A supporting upper ends of the front forks 3 and 3; a front wheel 5 freely rotatably supported on the front forks 3 and 3; an engine 6 supported on the vehicle body frame 2 on a substantial center of a vehicle body; a radiator 7 disposed in front of the engine 6; a swing arm 8 supported on the vehicle body frame 2 in rear of the engine 6 so as to be freely swingable in the up-and-down direction; a rear wheel 9 freely rotatably supported on rear end portions of the swing arm 8; a rear cushion 10 disposed between a rear portion of the swing arm 8 and the vehicle body frame 2; a fuel tank 11 disposed on an upper portion of the vehicle body frame 2; and a seat 12 disposed in rear of the fuel tank 11.

Between the top bridge 3A and a bottom bride 3B, which longitudinally support the front forks 3, there are attached a headlight 13, a front cowling 14, direction indicators 15, and meters 16. A front fender 17 that covers an upper portion of the front wheel 5 is attached to the front forks 3 and 3. A rear cowling 18 and a rear fender 19 are attached to a rear portion of the vehicle body frame 2. A taillight 20 and direction indicators 21 are attached to the rear cowling 18.

Figure 2:
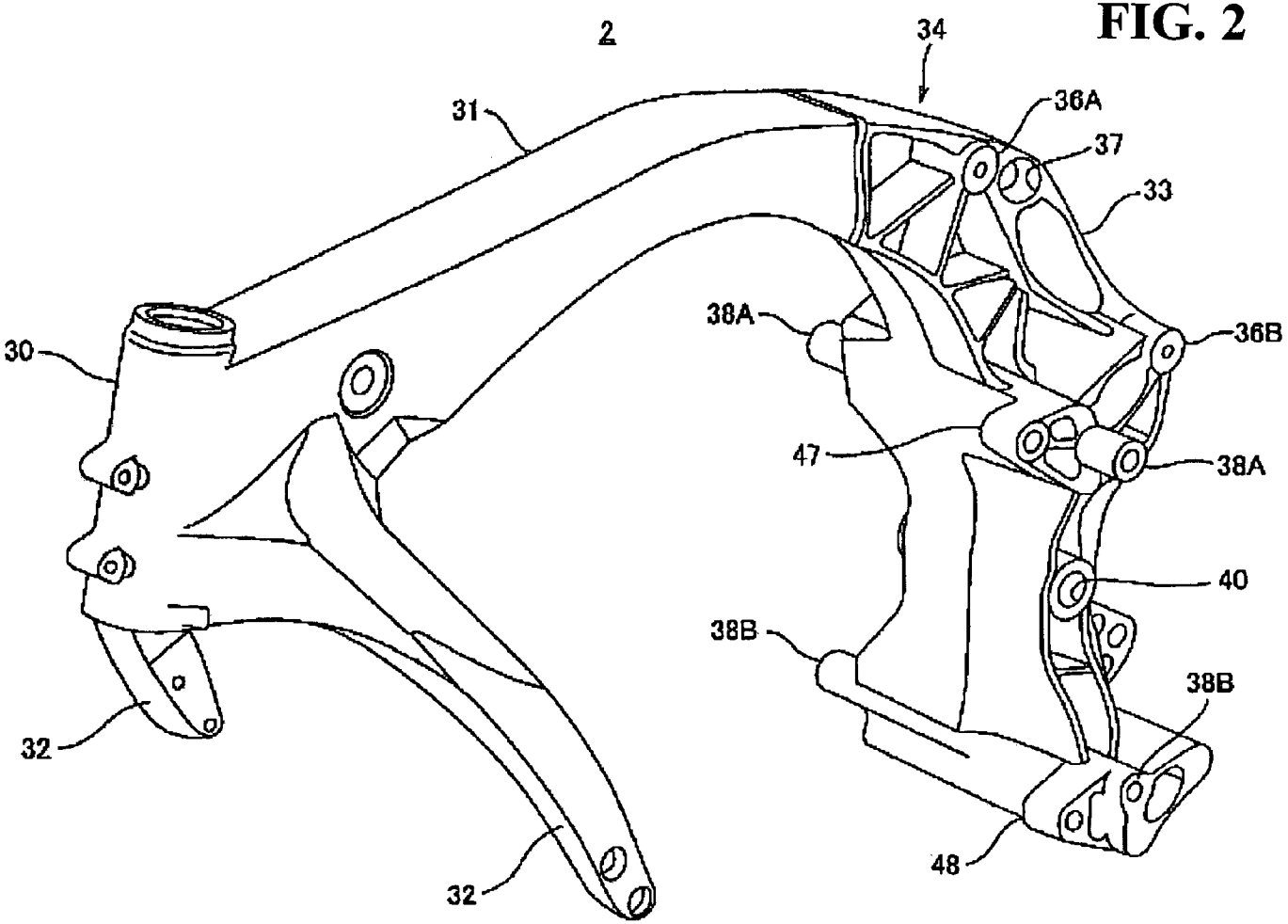
FIG. 2 is a perspective view showing a vehicle body frame.

FIG. 2 is a view showing the vehicle body frame 2. A cast frame made of aluminum metal is applied to the vehicle body frame 2. The vehicle body frame 2 includes: a head pipe 30; one main tube 31 of an oblong cross-section extended from the head pipe 30 substantially horizontally toward the rear; a left and right pair of down tubes 32 and 32 of an oblong cross-section extended downward from the head pipe 30; and one pivot frame 33 bent from a rear end of the main tube 31 so as to draw a gentle arc and extended downward of the vehicle body. One center frame 34 is composed of the main tube 31 and the pivot frame 33.

On an upper portion of the pivot frame 33, seat rail attachment portions 36A and 36B are formed at a longitudinal interval. To the seat rail attachment portions 36A and 36B, there are attached front portions of upper seat rails 35A (refer to FIG. 1) and lower seat rails 35B (refer to FIG. 1) extended upward toward the rear of the vehicle body. A cushion support portion 37 supporting an upper portion of the rear cushion 10 (refer to FIG. 1) is formed between the seat rail attachment portions 36A and 36B.

An upper and lower pair of boss portions 38A and 38B are formed left and right in a substantial intermediate portion and lower portion of the pivot frame 33. As shown in FIG. 1, to the boss portions 38A and 38B, a left and right pair of pivot brackets 39 and 39 are fastened by bolts so as to sandwich the pivot frame 33 from left and right. In the pivot frame 33 and the left and right pair of pivot brackets 39 and 39, a pivot hole portion 40 (refer to FIG. 2) penetrating therethrough in a vehicle width direction is formed. Front ends of the swing arm 8 are freely rotatably supported through a pivot bolt 41 inserted to the pivot hole portion 40.

A left and right pair of step holders 44 and 44 that extend toward the rear of the vehicle body are attached to the pivot brackets 39. To lower front sides of the left and right step holders 44 and 44, steps 45 and 45 for a rider are attached, and to rear end portions thereof, steps 46 and 46 for a passenger are attached.

Moreover, as shown in FIG. 1 and FIG. 2, to the pivot frame 33, engine hangers 47 and 48 are individually provided at a longitudinal interval. A rear portion of the engine 6 is supported through the engine hangers 47 and 48, and a front portion of the engine 6 is supported on the down tubes 32 and 32 through brackets 49. In such a way, the engine 6 is supported in a gap surrounded by the center frame 34 and the down tubes 32 and 32, when viewed from a side.

As shown in FIG. 1, the engine 6 includes: a crankcase 50; a cylinder block 51 formed integrally with the crankcase 50 so as to be extended substantially upward from a front portion of the crankcase 50; a cylinder head 52 coupled to an upper portion of the cylinder block 51; and a head cover 53 coupled to an upper portion of the cylinder head 52. The engine 6 is an in-line four-cylinder engine in which four cylinders are arranged abreast in the cylinder block 51.

In the cylinder block 51, pistons are housed in the respective cylinders so as to freely reciprocate therein. In the crankcase 50, a crankshaft coupled to the pistons through connecting rods, and an output shaft 55 of the engine 6 are axially supported. In the cylinder head 52, intake valves and exhausts valves are arranged, which open and close intake ports and exhaust ports, respectively, in an interlocking manner with a rotation of the crankshaft. Sprockets 56 and 57 are provided on the output shaft 55 and the rear wheel 9, respectively, and a drive chain 58 is wound around the sprockets 56 and 57, whereby a chain transmission mechanism is composed. Power of the engine 6 is transmitted to the rear wheel 9 through the chain transmission mechanism.

On a front surface of the cylinder head 52, exhaust ports 52A individually communicating with the exhaust ports of the respective cylinders are provided. Exhaust pipes 60 are individually connected to the respective exhaust ports 52A. The respective exhaust pipes 60 extend downward of the vehicle body from the respective exhaust ports 52A, extend out below the crankcase 50 toward the rear of the vehicle body, and are connected to a collecting exhaust pipe 61. A rear end of the collecting exhaust pipe 61 is connected to a muffler 65. In this construction, the muffler 65 is composed of a first muffler 65A extended below the engine 6 in a fore and aft direction of the vehicle body so as to be adjacent to the collecting exhaust pipe 61, and of a second muffler 65B passing from the first muffler 65A through a space between the engine 6 and the rear wheel 9 to be disposed on a front right side of the rear wheel 9. With this construction of the muffler, the second muffler 65B disposed on the right side of the vehicle body can be downsized while ensuring sufficient muffler capacity. Moreover, the muffler 65 being a heavy load is disposed close to a center lower portion of the vehicle body to thereby centralize the mass and to lower the center of gravity.

On a back surface of the cylinder head 52, intake ports 52B individually communicating with the intake ports of the respective cylinders, are provided. A fuel injection device 70 is connected to each of the intake ports 52B. An air cleaner 80 is coupled to the rear of the fuel injection device 70.

The fuel injection device 70 includes: throttle bodies 71 having therein valve bodies opening and closing in response to a throttle operation of the user; and four injectors 72, 72, 72 and 72 arranged in the throttle body 71 toward the respective intake ports 52B. The fuel injection device 70 adjusts, by the valve bodies, the amount of air supplied from the air cleaner 80 to each cylinder of the engine 6, injects fuel in the fuel tank 11 from the injectors 72, 72, 72 and 72 by control of a control unit (ECU, not shown), and supplies an air-fuel mixture in which fuel and air are mixed together, to the engine 6.

Figure 3:
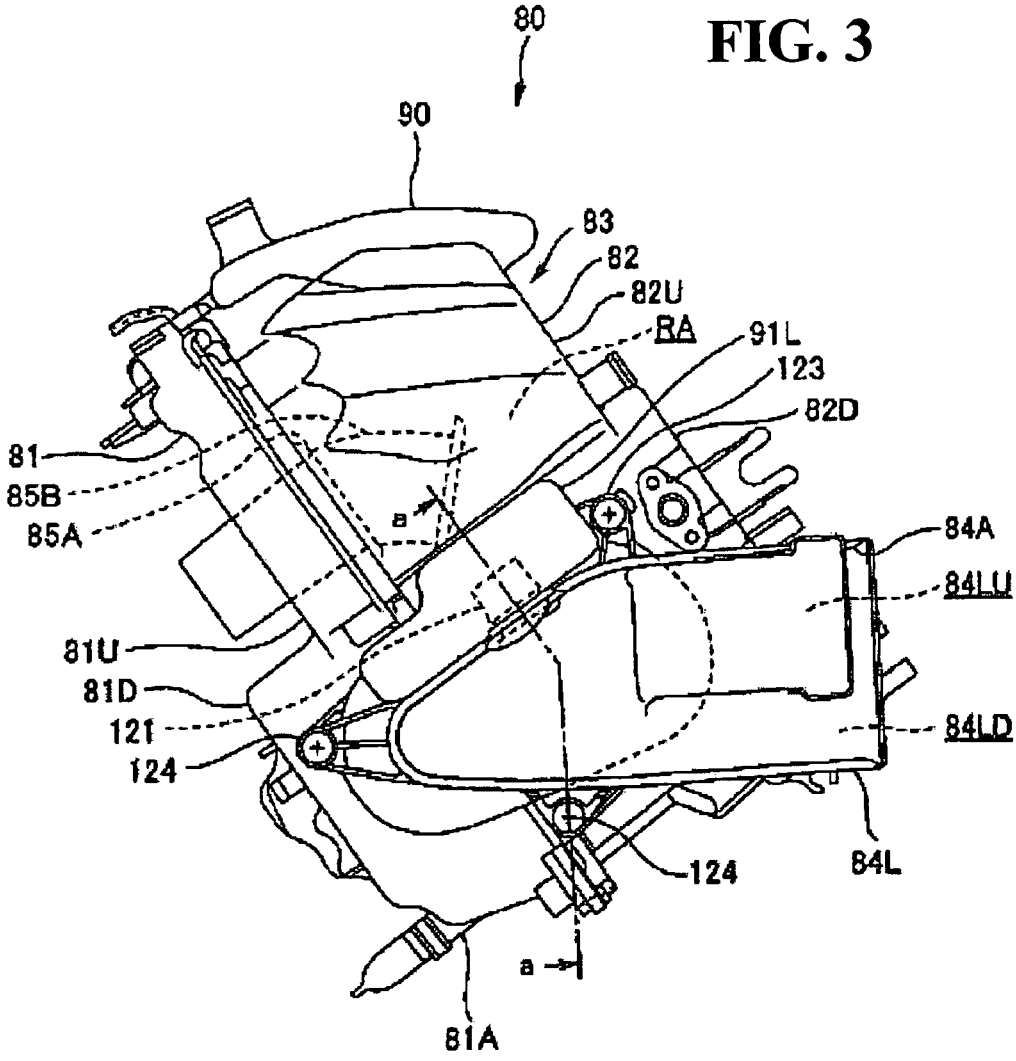
FIG. 3 is a side view of an air cleaner.
Figure 4:
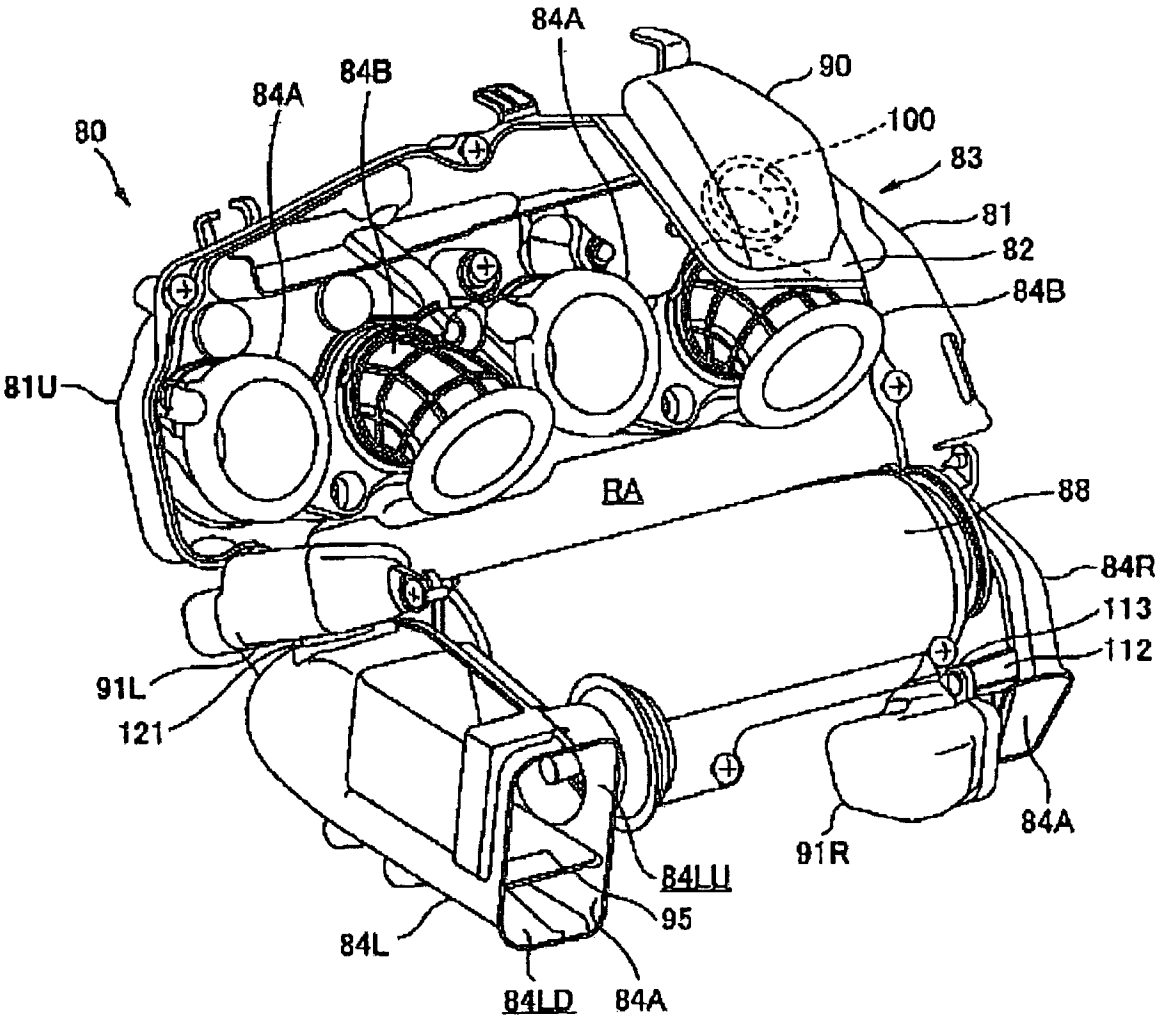
FIG. 4 is a perspective view showing an internal structure of the air cleaner.
Figure 5:
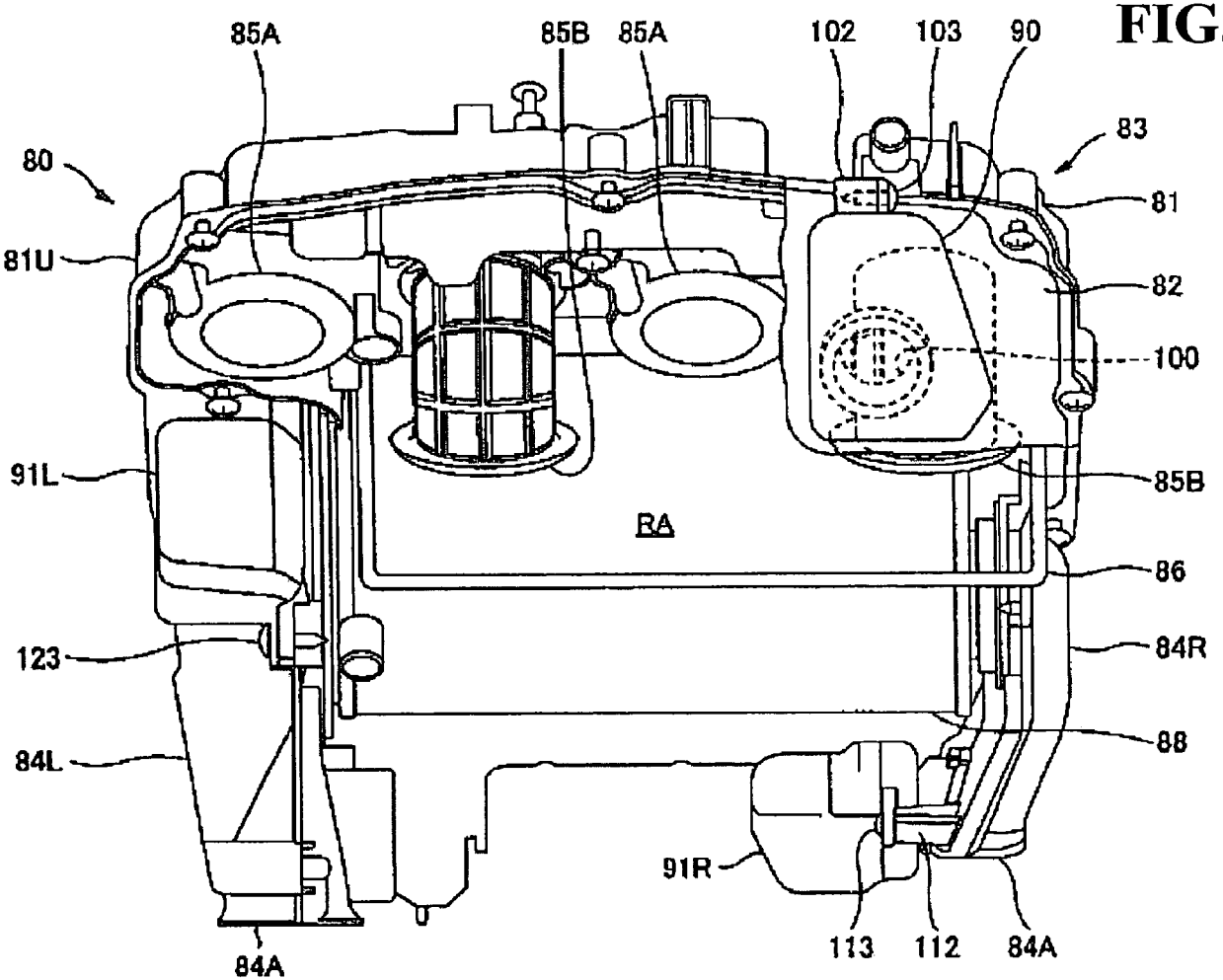
FIG. 5 is a plan view showing the internal structure of the air cleaner.

FIG. 3 is a side view of the air cleaner 80, FIG. 4 is a perspective view showing an internal structure thereof, and FIG. 5 is a plan view showing the internal structure. The air cleaner 80 is disposed adjacent to a lower portion of the main tube 31, and is thereby disposed in a gap between the main tube 31 and the engine 6 as shown in FIG. 1.

As shown in FIG. 3, the air cleaner 80 includes: an air cleaner case 83 dividable into a front case 81 and a rear case 82; and a left and right pair of intake ducts 84L and 84R (refer to FIG. 4) introducing the outside air into an internal space (hereinafter, referred to as an expansion chamber RA) of the air cleaner case 83.

The air cleaner case 83 is formed in a substantially longitudinally oblong box shape extended in the vehicle width direction, in which a longitudinal dimension is longer than a fore and aft depth dimension when viewed from the side. As shown in FIG. 1 and FIG. 3, the air cleaner case 83 is disposed on the vehicle body frame 2 in a posture where a front side thereof is tilting downward. A back surface of the air cleaner case 83, that is, a back surface of the rear case 82 is formed in an inclined surface that is inclined along the main tube 31, whereby the back surface of the air cleaner case 83 can be disposed close to the main tube 31.

As shown in FIG. 3 and FIG. 4, in an upper half portion 81U of the front case 81, four air funnels 85A, 85B, 85A and 85B are arranged abreast at an interval, and a lower half portion 81D of the front case 81 is formed in a shape protruding forward in order to ensure the capacity of the expansion chamber RA of the air cleaner 80. On a lower portion of the front case 81, a hose connection port 81A in communication with the inside of the air cleaner case 83 is provided. A drain hose is connected to the hose connection port 81A.

The air funnels 85A, 85B, 85A and 85B include the air funnels 85A with short funnel lengths, and the air funnels 85B with funnel lengths longer than that of the air funnels 85A. These air funnels 85A and 85B of different funnel lengths are alternately arranged. The air funnels 85A and 85B will be expressed below as the air funnels 85, unless it is particularly necessary to distinguish the two.

Front portions of the air funnels 85 penetrate through the front case 81 and are coupled to the throttle bodies 71. Rear portions of the air funnels 85 open in an inside of the upper half portion 82U of the rear case 82. More specifically, the rear portions of the air funnels 85A with short funnel lengths open to the rear case 82 side at positions close to the front case 81, and the rear portions of the air funnels 85B with long funnel lengths are bent in the rear case 82 so as to face obliquely downward toward the rear, and are arranged so that opening portions thereof can be directed to an air cleaner element (hereinafter, referred to as an element) 88 disposed in a lower portion of the rear case 82.

Note that, in FIG. 5, reference numeral 86 identifies a frame trap provided between the air funnels 85 and the element 88. The frame trap 86 composes a prevention wall preventing the element 88 being splashed with the fuel when fuel spitting from the air funnels 85 occurs.

A cylindrical air filter, including an air filter such as filter paper folded at a predetermined length interval, is applied to the element 88. As shown in FIG. 4 and FIG. 5, the element 88 is housed crosswise in a lower half portion 82D of the rear case 82, and both left and right end portions of the element 88, which are outside air inlet ports, communicate with insides of the left and right intake ducts 84L and 84R, respectively, through a through hole portion (not shown) penetrating crosswise through the air cleaner case 83.

The rear case 82 is formed in a bowl shape so as to form the expansion chamber RA in a space between the front case 81 and itself. The element 88 is disposed as described above in the lower portion of the expansion chamber RA. A space in the expansion chamber RA, which is around the element 88, becomes a clean side (clean air chamber) in which the air cleaned by the element 88 is stored. The internal space of the element 88 functions as a dark side (outside air chamber) in which the air (outside air) yet to be cleaned is stored.

The left and right intake ducts 84L and 84R have, when viewed from the side, tube shapes with a substantially oblong cross-section extended substantially horizontally toward the rear from both left and right end portions of the element 88, serving as the base end. The intake ducts 84L and 84R capture the outside air from opening portions 84A and 84A open to the rear thereof, introduce the outside air into the element 88 (which is the dark side), and allow the air cleaned by the element 88 to be supplied to the inside of the air cleaner case 83 (clean side).

The intake ducts 84L and 84R are arranged left and right as described above, whereby a larger duct capacity than in an arrangement of only one intake duct, can be easily ensured. In addition, the outside air can be efficiently introduced into the element 88 from the left and right sides of the tubular element 88. In such a way, intake resistance can be reduced. Moreover, since the intake ducts 84L and 84R extend substantially horizontally toward the rear, the air warmed by the engine 6 is not taken in, while the relatively low-temperature outside air in a position away from the engine 6 can be introduced to the inside of the air cleaner case 83.

The left and right intake ducts 84L and 84R have duct shapes different from each other. More specifically, the intake duct 84L on one side (left side of the vehicle body) is formed so that a passage length (so-called duct length) thereof can be longer than a passage length of the intake duct 84R on the other side (right side on the vehicle body), and so that an opening area thereof can be wider.

Figure 6C:
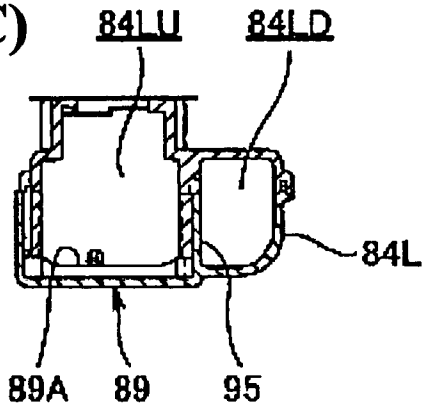
FIG. 6C is a cross section along the line 6C-6C of FIG. 6B.
Figure 6B:
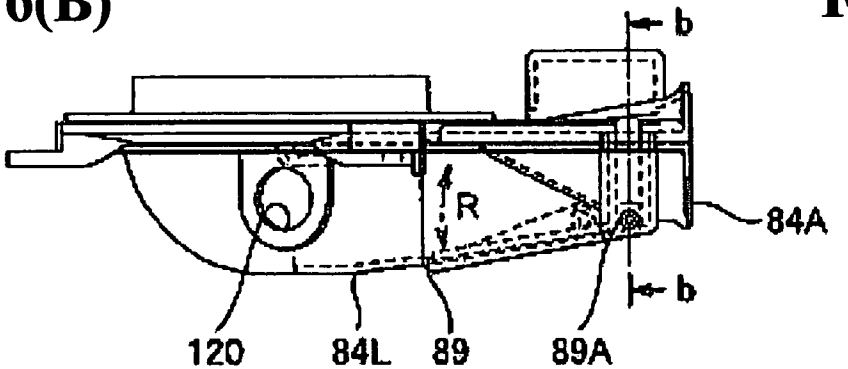
FIG. 6B is a view thereof viewed from above.
Figure 6A:
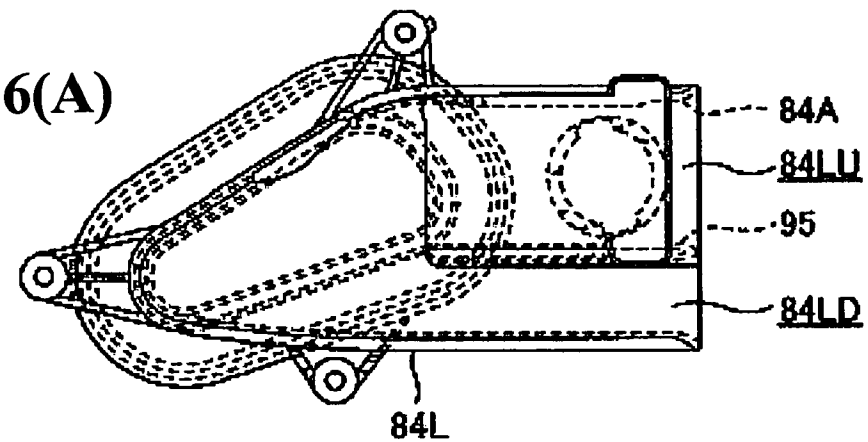
FIG. 6A is a view of a left-side intake duct viewed from a side.

FIG. 6(A) is a view of the intake duct 84L viewed from the side, FIG. 6(B) is a view thereof viewed from above, and FIG. 6(C) shows a cross section of FIG. 6(A) along the line 6C-6C. In the intake duct 84L on one side (left side of the vehicle body), which has a larger capacity, an opening/closing valve 89 opening and closing the opening of the duct 84L is disposed. A negative pressure of intake passages of the engine 6 is used as a drive source of the valve 89.

More specifically, as shown in FIGS. 6B and 6C, the opening/closing valve 89 has a plate shape, in which a shaft 89A is formed on one end. The shaft 89A is freely rotatably supported in the intake duct 84L, whereby the opening/closing valve 89 is supported so as to be freely openable and closable in a direction of arrow R. The opening/closing valve 89 is urged to an opening direction by a return spring (not shown), and is constructed so as to close against an urging force of the return spring when the negative pressure on the intake side of the engine 6 is applied thereto. In this construction, in the intake duct 84L, a partition plate portion 95 partitioning the intake duct 84L into an upper space 84LU and a lower space 84LD is provided. An opening of the upper space 84LU partitioned by the partition plate portion 95 is opened and closed by the opening/closing valve 89, whereby the area of the duct is appropriately varied in response to a request from the engine 6. In this case, the opening/closing valve 89 is disposed in the intake duct 84L with a long duct length, and accordingly, the opening/closing valve 89 can be arranged easily.

In response to the negative pressure on the intake side of the engine 6, the cleaned air introduced from the intake ducts 84L and 84R through the element 88 into the air cleaner case 83 is supplied through the air funnels 85A, 85B, 85A and 85B to the fuel injection device 70, where the cleaned air is mixed with the fuel, and is supplied to the engine 6.

Incidentally, when the engine 6 is driven, intake noise is generated, such as valve sounds generated when the intake valves driven in the engine 6 hit the cylinder head 52, and an intake sound generated when the engine 6 aspirates air. The intake noise passes through the intake passages of the engine 6, and in the air cleaner 80, some parts of the intake noise are mutually cancelled to be attenuated, and parts mutually equal in phase, are mutually promoted to be amplified, both of which are emitted from the air cleaner 80 to the outside.

In the air cleaner 80 of the present construction, for the purpose of reducing the intake noise emitted to the outside, as shown in FIG. 3 to FIG. 5, a case resonator 90 is provided on an upper portion of the air cleaner case 83, and duct resonators 91L and 91R are provided on the left and right intake ducts 84L and 84R, respectively. The intake noise is attenuated by these three resonators 90, 91L and 91R.

Figure 7:
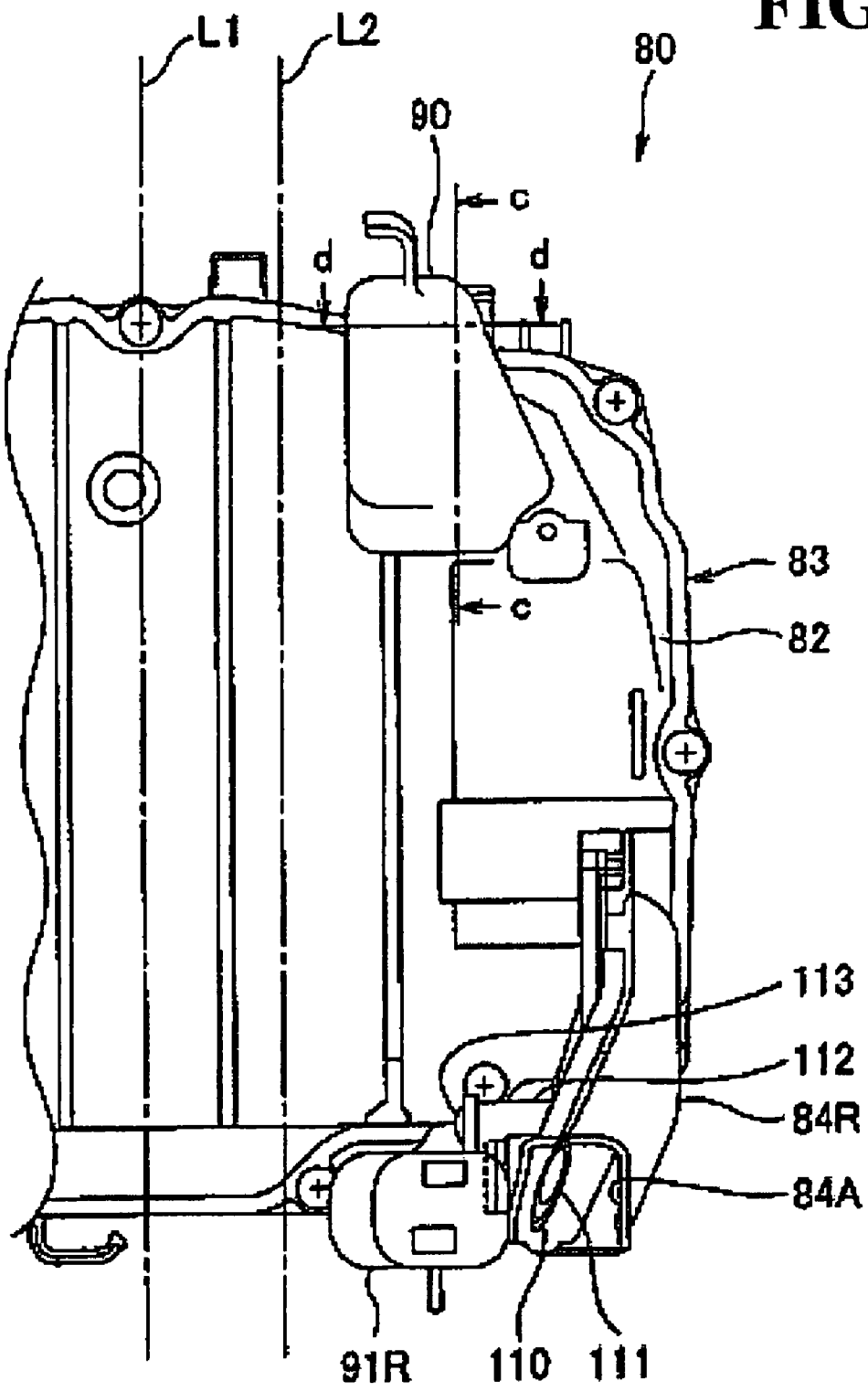
FIG. 7 is a view showing a case resonator for an air cleaner case together with a peripheral construction.
Figure 8A:
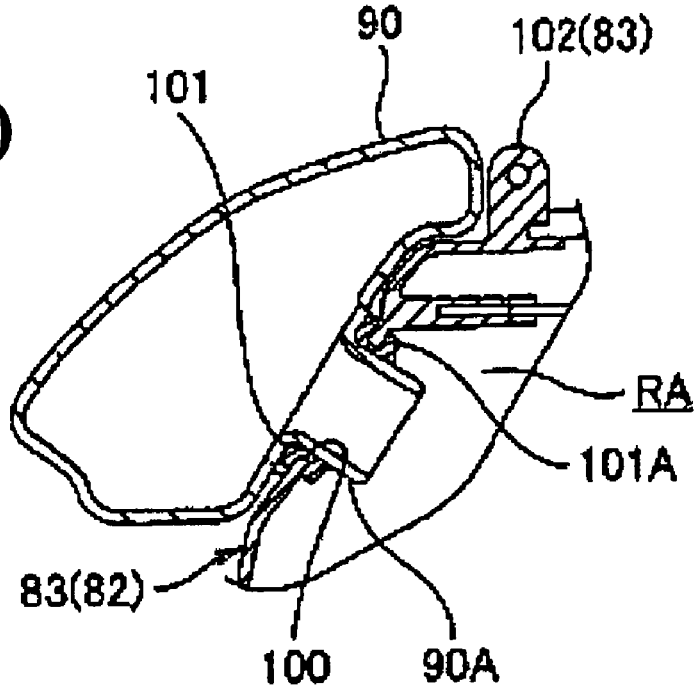
FIG. 8A is a cross section along the line 8A-8A of FIG. 7.
Figure 8B:
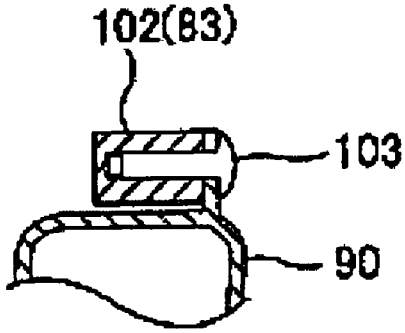
FIG. 8B is a cross section along the line 8B-8B of FIG. 7.

A description will now be made in detail of the case resonator 90 and the duct resonators 91L and 91R. FIG. 7 is a view showing the case resonator 90 of the air cleaner case 83 together with the peripheral construction. FIG. 8A shows a cross section of FIG. 7 along the line 8A-8A, and FIG. 8B shows a cross section of FIG. 7 along the line 8B-8B. Note that, in FIG. 7, a line L1 indicates a centerline (vehicle fore and aft centerline) in the fore and aft direction of the vehicle body, and a line L2 shows an outline of the center frame 34.

As shown in FIG. 7, the case resonator 90 is disposed at a side (right side) position on an upper surface of the air cleaner case 83 (upper surface of the rear case 82) so as to be located on a side (right side) of the main tube 31.

More specifically, on the upper surface of the air cleaner case 83, as shown in FIG. 5, a through hole 100 is formed at a position close to the respective opening portions of the air funnel 85B and the air funnel 85A, which are located on the right side when viewed from the above. A tube 101 is attached to the through hole 100, as shown in FIG. 8A, the tube 101 including a sandwiching portion 101A that sandwiches an edge portion of the through hole 100. A pipe portion 90A formed integrally with the case resonator 90 is fitted to the tube 101. In such a fitted state, as shown in FIG. 8B, the case resonator 90 is fixed to a boss portion 102 formed on the air cleaner case 83 by a tapping screw 103.

The case resonator 90 is a resonator generating a resonant wave that is resonant with the intake noise emitted from the engine 6 into the expansion chamber RA of the air cleaner case 83, thereby attenuating the intake noise. Specifically, a capacity of the resonator 90, a length of the pipe portion 90A, an opening area of the pipe portion 90A, and the like are adjusted, whereby, for example, a resonant wave is generated, in which the frequency is substantially the same as the frequency of a standing wave following the intake noise emitted into the expansion chamber RA, and the phase is different from that of the standing wave by 180°, and then the resonant wave and the standing wave are made to interfere with each other, thereby attenuating the standing wave.

Moreover, as shown in FIG. 7 and FIG. 8A, the case resonator 90 is formed in a flat shape going substantially along the upper surface of the air cleaner case 83 (upper surface of the rear case 82), and in addition, is disposed at a more sideward position than the outline L2 of the center frame 34. In such a way, the case resonator 90 avoids interference with the center frame 34 (main tube 31). Moreover, the case resonator 90 suppresses a protrusion amount thereof from the air cleaner 80 while ensuring sufficient capacity, to avoid possible upsizing of the air cleaner 80. Hence, the case resonator 90 can surely avoid interference with various parts arranged in the periphery of the air cleaner 80.

Figure 9A:
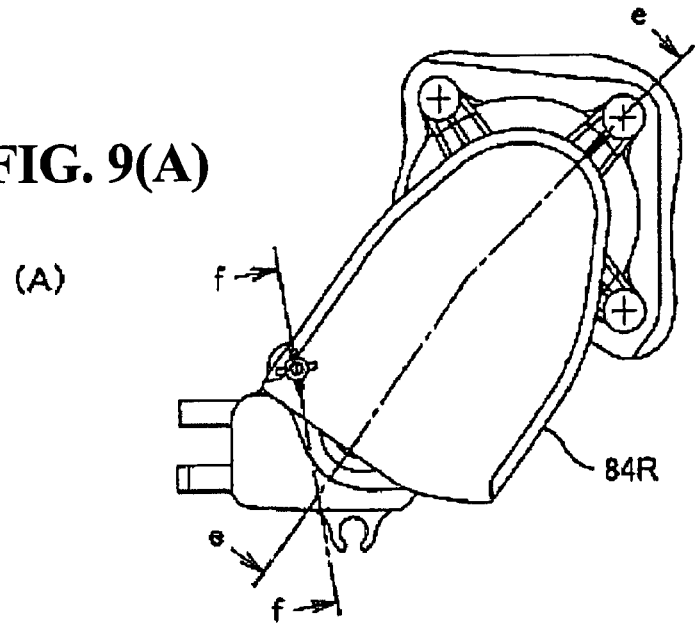
FIG. 9A is a view of a right-side intake duct viewed from a side together with a duct resonator.

Moreover, as shown in FIG. 7, the duct resonator 91R on the right side is disposed on an inner side (vehicle fore and aft centerline L1 side) in the vicinity of an opening portion of the intake duct 84R. FIG. 9A is a view of the intake duct 84R viewed from the side together with the duct resonator 91R, FIG. 9B shows a cross section of FIG. 9A along the line 9B-9B, and FIG. 9C is a view showing a cross-section of FIG. 9A along the line 9C-9C.

Figure 9B:
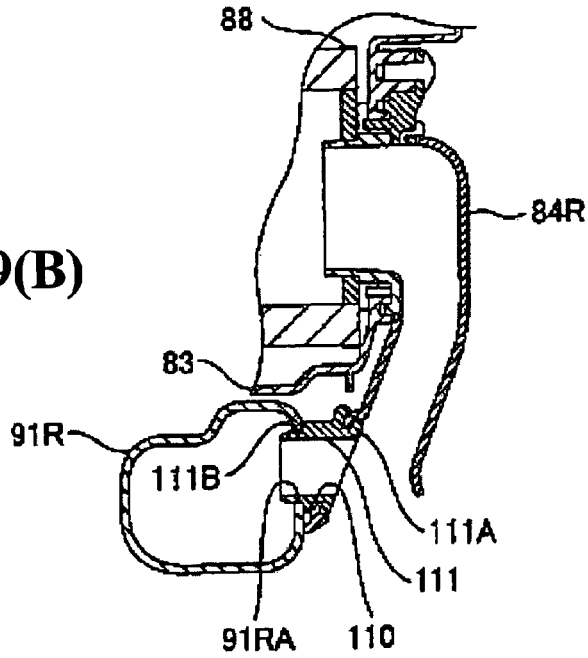
FIG. 9B is a cross section along the line 9B-9B of FIG. 9A.
Figure 9C:
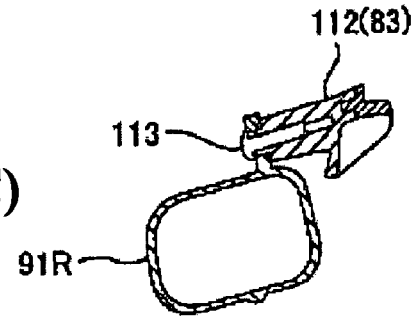
FIG. 9C is a cross section along the line 9C-9C of FIG. 9A.

As shown in FIG. 9(B), a through hole 110 is formed on an inside wall of the intake duct 84R. To the through hole 110, a tube 111 including a sandwiching portion 111A that sandwiches an edge portion of the through hole 110 is attached.

In the tube 111, on an end portion thereof opposite from the sandwiching portion 111A, an engagement portion 111B is formed, with which a hole portion 91RA formed in the duct resonator 91R is engaged. In a state where the hole portion 91RA is engaged with the engagement portion 111B, as shown in FIG. 9C, the duct resonator 91R is fixed to a boss portion 112 formed on the air cleaner case 83, by a tapping screw 113.

The duct resonator 91R is a resonator generating a resonant wave that is resonant with the intake noise emitted from the engine 6 through the expansion chamber RA of the air cleaner case 83 into the intake duct 84R and with the intake noise generated when the outside air is aspirated into the intake duct 84R, thereby attenuating such intake noise. Specifically, a capacity of the duct resonator 91R, a length of the tube 111, an opening area of the tube 111, and the like are adjusted, whereby, for example, a resonant wave is generated, in which the frequency is substantially the same as the frequency of a standing wave generated in the intake duct 84R, and the phase is different from that of the standing wave by 180°, and then the resonant wave and the standing wave are made to interfere with each other, thereby attenuating the standing wave.

Moreover, the duct resonator 91R is disposed on an inner side (vehicle fore and aft centerline L1 side shown in FIG. 7), and is formed in a box shape going substantially along the back surface of the air cleaner case 83. In such a way, the duct resonator 91R can ensure sufficient capacity without projecting from the air cleaner case 83, to avoid possible upsizing of the air cleaner 80.

Figure 10:
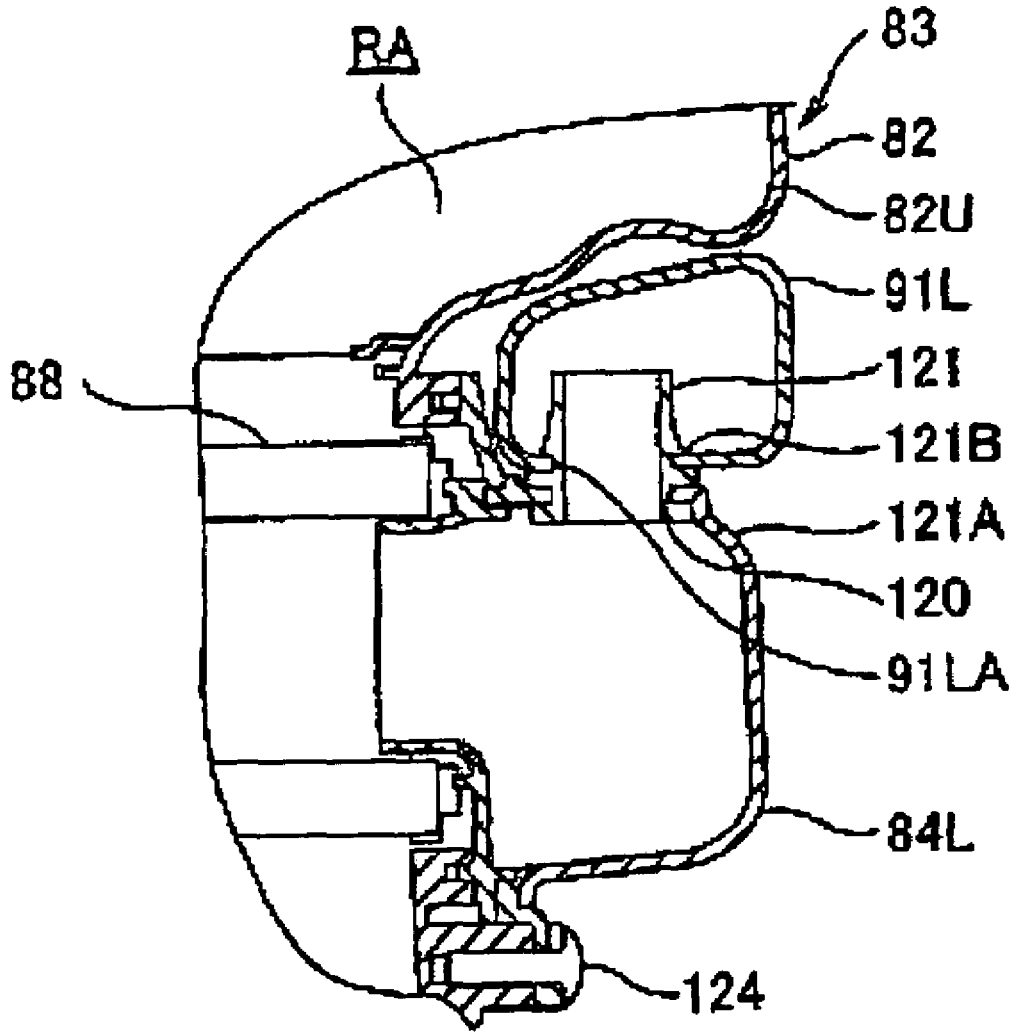
FIG. 10 is a cross section along the line 10-10 of FIG. 3.

As shown in FIG. 3, the duct resonator 91L on the left side is disposed in a gap formed between the intake duct 84L and the upper half portion 82U of the rear case 82. FIG. 10 shows a cross section of FIG. 3 along the line 10-10. Note that an attachment structure of the duct resonator 91L is substantially the same as the attachment structure of the above-described duct resonator 91R.

Describing in detail, as shown in FIG. 10, a through hole 120 is formed on an upper wall of the intake duct 84L. To the through hole 120, a tube 121 including a sandwiching portion 121A that sandwiches an edge portion of the through hole 120 is attached. In the tube 121, on an end portion thereof opposite from the sandwiching portion 121A, an engagement portion 121B is formed, with which a hole portion 91LA formed in the duct resonator 91L is engaged. Then, in the state where the hole portion 91LA is engaged with the engagement portion 121B, as shown in FIG. 3, the duct resonator 91L is fixed to the air cleaner case 83 by a tapping screw 123.

As shown in FIG. 3, the tapping screw 123 also serves as one of a plurality (three in this construction) of tapping screws 123, 124 and 124 attaching the intake duct 84L to the air cleaner case 83. Hence, the number of tapping screws 123, 124 and 124 to be used is reduced.

The duct resonator 91L is a resonator generating a resonant wave that is resonant with the intake noise emitted from the engine 6 through the expansion chamber RA of the air cleaner case 83 into the intake duct 84L and with the intake noise generated when the outside air is aspirated into the intake duct 84L, thereby attenuating such intake noise. Specifically, a capacity of the duct resonator 91L, a length of the tube 121, an opening area of the tube 121, and the like are adjusted, whereby, for example, a resonant wave is generated, in which the frequency is substantially the same as the frequency of a standing wave generated in the intake duct 84L, and the phase is different from that of the standing wave by 180°, and then the resonant wave and the standing wave are made to interfere with each other, thereby attenuating the standing wave. In this case, the duct resonator 91L is formed so that the capacity thereof can be larger than that of the duct resonator 91R provided on the intake duct 84R that is shorter than the intake duct 84L, on which the resonator 91L is provided.

Moreover, the duct resonator 91L goes along a gap formed between the intake duct 84L and the upper half portion 82U of the rear case 82, and is formed in a box shape that does not project from the air cleaner case 83 to the outside. In such a way, the duct resonator 91L can ensure sufficient capacity without projecting from the air cleaner case 83 to the side of the vehicle body, and can avoid possible upsizing of the air cleaner 80.

As described above, in this embodiment, provided are the case resonator 90 attenuating the sound in the expansion chamber RA of the air cleaner 80, and the duct resonators 91L and 91R attenuating the sounds in the left and right pair of intake ducts 84L and 84R. Accordingly, by providing the plurality of resonators 90, 91R and 91L, the intake noise generated on the engine 6 side and emitted to the outside through the air cleaner 80 and the intake noise generated when the outside air is aspirated into the air cleaner 80, can be attenuated.

In this case, the case resonator 90 attenuates the intake noise that has just been generated on the engine 6 side and has passed through the air funnel 85. Accordingly, the intake noise can be attenuated at positions close to the engine 6 being a main source (sound source) of the intake noise. In addition, the duct resonators 91L and 91R attenuate the intake noise in the intake ducts 84L and 84R as outlets of the intake noise. As a result, the intake noise can be efficiently attenuated.

In addition, the plurality of resonators 90, 91R and 91L are arranged on the air cleaner 80 in a dispersed manner. Consequently, the respective resonators 90, 91R and 91L can be downsized while ensuring sufficient capacity as a whole of the resonators, and the resonators can be arranged easily at positions avoiding interference with other parts such as the vehicle body frame 2.

As above, the description has been made of the present invention on the basis of the embodiment; however, it is obvious that the present invention is not limited to this. For example, in the above-described embodiment, the description has been made of the case where the present invention is applied to the air cleaner 80 for a motorcycle including an in-line four-cylinder engine; however, without being limited to this, the present invention is widely applicable to publicly known air cleaners such as air cleaners for motorcycles including other multi-cylinder engines such as a V-type engine, and a single-cylinder engine. Moreover, the present invention may be applied to an air cleaner for a scooter-type motorcycle.

Furthermore, the number of resonators 90, 91R and 91L is not limited to three. In effect, the resonators just need to be individually provided on the expansion chamber and the intake ducts. For example, a plurality of resonators may be provided on the expansion chamber RA. Furthermore, the shapes of the resonators 90, 91R and 91L are not limited to the shapes described above, and may be changed arbitrarily in dependence with the spaces where these resonators are arranged.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An intake system of a motorcycle, comprising:

an air cleaner connected to an upstream side of an intake passage, the intake passage being connected to an intake port of a cylinder of an engine, said air cleaner including:

an air cleaner case having an expansion chamber, the intake passage being connected to the expansion chamber;

an element; and an intake duct for introducing outside air into the air cleaner case; and resonators provided on the air cleaner, the resonators being individually provided in communication with the expansion chamber and the intake duct, wherein a pair of said intake ducts are provided on left and right sides of the air cleaner case, the intake duct on a first side is made longer than the intake duct on a second side, and a capacity of the resonator provided on the intake duct on the first side is larger than a capacity of the resonator provided on the intake duct on the second side.

2. The intake system of a motorcycle according claim 1, wherein the intake duct on the first side includes an opening/closing valve for opening and closing an opening of the intake duct.

3. The intake system of a motorcycle according to claim 2, wherein the air cleaner is disposed adjacent to a lower portion of a main tube that extends in a fore and aft direction of a vehicle body, the resonator provided on the expansion chamber is disposed on a side of the main tube on an upper surface of the air cleaner case, and the resonators are individually provided on the pair of intake ducts.

4. The intake system of a motorcycle according to claim 1, wherein the air cleaner is disposed adjacent to a lower portion of a main tube that extends in a fore and aft direction of a vehicle body, the resonator provided on the expansion chamber is disposed on a side of the main tube on an upper surface of the air cleaner case, a pair of the intake ducts are provided on left and right sides of the air cleaner case, and the resonators are individually provided on the pair of intake ducts.

5. The intake system of a motorcycle according to claim 1, wherein the air cleaner is disposed adjacent to a lower portion of a main tube that extends in a fore and aft direction of a vehicle body, the resonator provided on the expansion chamber is disposed on a side of the main tube on an upper surface of the air cleaner case, and the resonators are individually provided on the pair of intake ducts.

6. The intake system of a motorcycle according to claim 1, wherein an upper surface of the air cleaner case has a through hole formed therethrough into the expansion chamber, a tube is attached to the through hole, and a pipe portion formed integrally with the resonator provided on the expansion chamber is fitted to the tube.

7. The intake system of a motorcycle according to claim 6, wherein a through hole is formed on an inside wall of the intake duct, a tube is attached to the through hole, and the resonator provided on the intake duct is connected to the tube.

8. The intake system of a motorcycle according to claim 1, wherein a through hole is formed on an inside wall of the intake duct, a tube is attached to the through hole, and the resonator provided on the intake duct is connected to the tube.

9. An intake system for a motorcycle, comprising:

an air cleaner case having an expansion chamber, the expansion chamber being connectable to an intake passage of an engine;

an intake duct for introducing outside air into the air cleaner case;

a filter element located within the air cleaner case; and resonators provided in communication with the expansion chamber and the intake duct, wherein a pair of said intake ducts are provided on left and right sides of the air cleaner case, the intake duct on a first side is made longer than the intake duct on a second side, and a capacity of the resonator provided on the intake duct on the first side is larger than a capacity of the resonator provided on the intake duct on the second side.

10. The intake system for a motorcycle according to claim 9, wherein the intake duct on the first side includes an opening/closing valve for opening and closing an opening of the intake duct.

11. The intake system for a motorcycle according to claim 10, wherein the air cleaner is disposed adjacent to a lower portion of a main tube that extends in a fore and aft direction of a vehicle body, the resonator provided on the expansion chamber is disposed on a side of the main tube on an upper surface of the air cleaner case, and the resonators are individually provided on the pair of intake ducts.

12. The intake system for a motorcycle according to claim 9, wherein the air cleaner is disposed adjacent to a lower portion of a main tube that extends in a fore and aft direction of a vehicle body, the resonator provided on the expansion chamber is disposed on a side of the main tube on an upper surface of the air cleaner case, a pair of the intake ducts are provided on left and right sides of the air cleaner case, and the resonators are individually provided on the pair of intake ducts.

13. The intake system for a motorcycle according to claim 9, wherein the air cleaner is disposed adjacent to a lower portion of a main tube that extends in a fore and aft direction of a vehicle body, the resonator provided on the expansion chamber is disposed on a side of the main tube on an upper surface of the air cleaner case, and the resonators are individually provided on the pair of intake ducts.

14. The intake system for a motorcycle according to claim 9, wherein an upper surface of the air cleaner case has a through hole formed therethrough into the expansion chamber, a tube is attached to the through hole, and a pipe portion formed integrally with the resonator provided on the expansion chamber is fitted to the tube.

15. The intake system for a motorcycle according to claim 14, wherein a through hole is formed on an inside wall of the intake duct, a tube is attached to the through hole, and the resonator provided on the intake duct is connected to the tube.

16. The intake system for a motorcycle according to claim 9, wherein a through hole is formed on an inside wall of the intake duct, a tube is attached to the through hole, and the resonator provided on the intake duct is connected to the tube.

* * * * *